United States Patent [19]

Kortge et al.

[11] Patent Number: 4,741,318

[45] Date of Patent: May 3, 1988

[54] CANISTER PURGE CONTROLLER

[75] Inventors: Jerry W. Kortge; Steven L. Piedmont, both of Clarkston, Mich.

[73] Assignee: General Motors Corporation, Detroit, Mich.

[21] Appl. No.: 899,259

[22] Filed: Aug. 22, 1986

[51] Int. Cl.[4] ..... F02M 25/08

[52] U.S. Cl. ..... 123/520

[58] Field of Search ..... 123/440, 489, 519, 520

[56] References Cited

U.S. PATENT DOCUMENTS

| | | | |
|---|---|---|---|
| 3,872,848 | 3/1975 | King | 123/519 |
| 4,013,054 | 3/1977 | Balsley et al. | 123/519 |
| 4,275,697 | 6/1981 | Stoltman | 123/520 |
| 4,467,769 | 8/1984 | Matsumura | 123/520 X |
| 4,641,623 | 2/1987 | Hamburg | 123/520 X |

*Primary Examiner*—Tony M. Argenbright
*Assistant Examiner*—Eric R. Carlberg
*Attorney, Agent, or Firm*—Howard N. Conkey

[57] ABSTRACT

A system and method of controlling the purge rate of a fuel vapor collection canister of an internal combustion engine in which the purge flow rate is variably controlled to a maximum rate that is established by the fuel control system based on its ability to maintain a desired air/fuel ratio.

4 Claims, 3 Drawing Sheets

CANISTER PURGE CONTROLLER

BACKGROUND OF THE INVENTION

This invention relates to an evaporative control system for an internal combustion engine and particularly to an apparatus and method of controlling the purge rate of fuel vapors from a fuel vapor collection canister.

It is conventional to use fuel vapor recovery canisters to control the loss of evaporative hydrocarbons from vehicle fuel tanks. Generally the canisters take the form of a container filled with activated charcoal or some other absorbing agent which is effective to store the evaporated hydrocarbons until they can be drawn into the induction system of the engine to undergo combustion in the engine cylinders. In these systems, the vacuum in the intake manifold of the engine is used to draw a purge stream of air through the canister so as to purge the collected vapors from the active material of the canister during each engine operation so as to condition the canister for collection of subsequently generated vapors.

It is desirable to provide high purge flow rates through the fuel vapor storage canister so that the canister is quickly purged of the absorbed fuel vapors thereby enabling the canister to have maximum working capacity when the engine is next shut down. However, if the purge flow rate through the canister is unrestricted when the canister contains a large amount of collected fuel vapors, the resulting large quantities of fuel vapor drawn into the engine induction system from the canister during high purge flow rate conditions, such as low engine speed/load conditions where the manifold vacuum level is high, results in an excessively rich air/fuel ratio of the mixture drawn into the engine. This rich mixture may affect both emissions from the engine and engine performance. The undesirable rich air/fuel ratio of the mixture would typically result even though the fuel delivery system of the engine employs closed loop control of the air/fuel ratio of the mixture delivered to the engine. This is because closed loop control systems generally have limited control authority. In other words, closed loop air/fuel ratio control systems typically have a limit in the maximum amount of adjustment that can be made in attempting to maintain a desired air/fuel ratio. When that limit has been reached as a result of large quantities of fuel vapors drawn into the engine from the canister, the closed loop controller is incapable of thereafter controlling the air/fuel ratio to the desired value until the amount of vapors being drawn into the engine from the canister decreases.

In order to prevent the air/fuel ratio of the mixture drawn into the engine cylinders from becoming excessively rich, canister purge control systems typically limit or restrict the canister purge flow rate via an orifice in the purge flow line. Generally, the size of the purge flow orifice employed to restrict the purge flow rate is selected as a compromise between a flow assuring maximum canister working capacity and a flow that assures that the authority of the closed loop air/fuel ratio controller is not exceeded so as to avoid the undesirable effects of returning large quantities of fuel vapor to the engine induction system. The selection of an orifice for achieving the foregoing is made more difficult because of the difficulty of controlling or quantifying the amount of vapor a canister may yield under continuously changing temperature and fuel RVP extremes.

SUMMARY OF THE INVENTION

In accord with this invention, the purge flow rate through the fuel vapor collection canister is variably controlled to a maximum rate that is established by the fuel control system based on its ability to maintain a desired air/fuel ratio. Closed loop air/fuel ratio controllers typically include an integrator that is responsive to a sensed error in the air/fuel ratio of the mixture delivered to the engine to provide an integral term correction to the fuel quantity delivered to the engi e in direction to establish a desired air/fuel ratio. The canister purge controller of this invention monitors the integral correction term of the closed loop fuel adjustment in the fuel delivery system of the engine as the purge flow rate is ramped in an increasing direction increasing the rate of fuel vapors drawn into the engine from the vapor collection canister. As the rate of fuel vapors purged from the vapor canister into the induction system increases as a result of the increased purge flow rate, the closed loop integral term of the fuel delivery system decreases the fuel otherwise delivered to the engine to compensate for the added fuel vapors so as to maintain the desired air/fuel ratio.

When the canister purge controller senses the integral term fuel adjustment becoming equal to a predetermined maximum value approaching the limit of the integral term in reducing the fuel otherwise delivered to the engine, the purge flow rate of the fuel vapor canister is held or reduced until the amount of adjustment of the integral correction decreases in response to a reduction in the rate of vapors purged from the canister. Thereafter, the canister purge flow rate is again increased while the integral term is again monitored. The foregoing closed loop control of the canister purge flow rate establishes a maximum canister purge flow rate at a value whereat the closed loop air/fuel ratio controller still has the capability of maintaining the desired air/fuel ratio while at the same time providing for the largest possible purge flow rate limited only by the ability of the closed loop control system to maintain control of the air/fuel ratio.

BRIEF DESCRIPTION OF THE DRAWINGS

The invention may be best understood by reference to the following description of a preferred embodiment and the drawings in which.

DESCRIPTION OF THE PREFERRED EMBODIMENT

Figure 1:
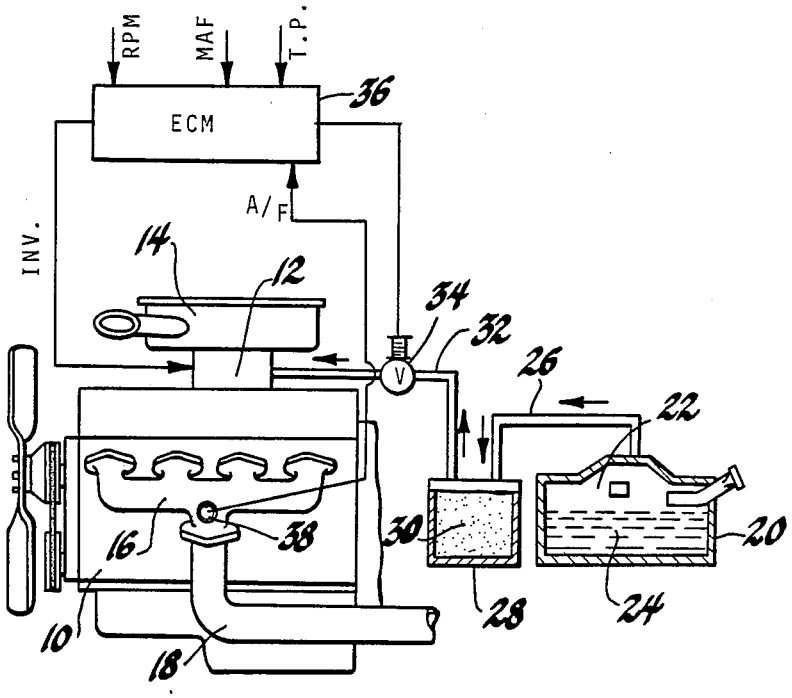
FIG. 1 illustrates an internal combustion engine and associated fuel system including a fuel vapor collection canister.

Referring to FIG. 1, there is illustrated an internal combustion engine 10 that includes a conventional throttle body 12 including a manually operable throttle in a throttle bore for controlling air flow into the engine 10. Air is drawn through the throttle body 12 into the engine 10 through an air cleaner 14 that further includes a mass air flow sensor for monitoring the mass air flow MAF into the engine 10. The throttle body 12 also includes a fuel injector positioned above the throttle blade for injecting fuel into the engine 10. The fuel is mixed with the air drawn through the throttle body 12 to provide a combustible mixture that is drawn into the cylinders of the engine 10 for combustion. The combustion byproducts from the cylinders are discharged into an exhaust manifold 16 and then into an exhaust conduit 18 from which it is discharged to the atmosphere.

The fuel delivered to the engine 10 via the fuel injector positioned in the throttle body 12 is drawn from a fuel tank 20 by a conventional fuel pump and fuel line (not shown). The fuel tank 20 includes a volume 22 above the surface of liquid fuel 24 which contains air and evaporated hydrocarbons (fuel vapor) and thus constitutes a fuel vapor space. The volume 22 communicates through a conduit 26 with a conventional fuel vapor storage canister 28. The fuel vapor storage canister 28 is filled with a hydrocarbon absorbing substance 30 such as activated carbon which captures fuel vapor before it can escape to the atmosphere. The canister 28 typically includes an opening at its bottom with an air filter through which air may pass into the canister 28.

The canister 28 also communicates through a purge conduit 32 and an electromagnetically controlled purge control valve 34 with the throttle body 12 at a point downstream from the throttle blade therein and which is exposed to the subatmospheric pressure in the intake manifold. The valve 34 is normally closed to prevent flow of air and fuel vapors from the canister 28 to the induction system of the engine 10. When the valve 34 is energized, the purge conduit 32 is opened and the subatmospheric pressure in the intake manifold of the engine 10 results in flow of air and vapor from the canister 28 into the induction system of the engine 10.

When the engine 10 is shut down and the valve 34 deenergized, the fuel vapors from the fuel tank 20 pass through the conduit 26 and are collected by the absorbing substance in the canister 28. When the purge control valve 34 is energized and the engine 10 is operating, the subatmospheric pressure in the intake manifold of the engine 10 applied through the purge line 32 to the canister 28 draws air through the canister 28 and purges the fuel vapors collected therein. The air and fuel vapor are drawn into the induction passage of the engine 10 where it is mixed with the air and fuel otherwise drawn into the engine 10 via the throttle body 12 as previously described.

The purge flow rate of air and fuel vapors when the purge valve 34 is open is maximum as determined by the magnitude of the subatmospheric pressure in the intake manifold of the engine 10. This purge flow rate may be modulated between this maximum value and zero by controlling the percentage time that the purge valve 34 is opened. For example, in this invention, the purge valve 34 is duty cycle modulated to establish an effective variable restriction in the purge line 32 to control the purge flow from the canister 28 into the induction system of the engine 10 and therefore the rate that fuel vapors are purged from the canister 28 into the induction system of the engine 10.

The injector in the throttle body 12 and the purge valve 34 are controlled by an engine control module (ECM) 36. In general, the fuel injector is controlled by the ECM 36 so as to achieve a desired air/fuel ratio. During an engine warmed up condition, the desired air/fuel ratio is typically the stoichiometric ratio. During other engine operating conditions, such as during engine warm up or during engine transient operation, the ratio may deviate from the stoichiometric ratio. The fuel injector is energized by an injection pulse provided by the ECM 36 once for each engine cylinder intake event. The duration of the injection pulse is generally determined based on the desired air/fuel ratio and the mass air flow (MAF) into the engine 10 as measured by the conventional mass air flow sensor in the air cleaner 14. Further, the ECM 36 provides for closed loop adjustment of the injection duration during warmed up engine operation so as to achieve a desired stoichiometric air/fuel ratio based upon the output of an oxygen sensor 38 that monitors the oxidizing/reducing condition of the exhaust gases discharged into the exhaust manifold 16 of the engine 10.

The oxygen sensor 38 is well known and takes the form of a zirconia sensor which generates a bilevel output voltage that is at a high voltage value when the air/fuel ratio of the mixture drawn into the cylinders is richer than the stoichiometric ratio and which provides a low voltage value when leaner than the stoichiometric ratio. Based on the deviation of the air/fuel ratio from the stoichiometric ratio as sensed by the oxygen sensor 38, the fuel pulse width provided to the injector is adjusted by integral and proportional terms to precisely provide the desired stoichiometric air/fuel ratio.

The proportional term is a value that either increases or decreases the fuel amount by a predetermined value dependent upon the sense of deviation of the air/fuel ratio from the stoichiometric ratio and the integral term is a value that is periodically adjusted (such as at intervals greater than the transport delay through the engine) in direction tending to restore the air/fuel ratio to the stoichiometric ratio. The integral term over time will be adjusted to the value that is required to establish the stoichiometric air/fuel ratio. When the integral term is adjusted to its limit in response to an excessively lean or rich air-fuel mixture, the closed loop control is no longer capable of controlling the air/fuel ratio to the stochiometric ratio.

After a prolonged period of activity, the canister 28 will have absorbed a substantial quantity of fuel vapor emitted through the conduit 26. Therefore, during initial engine operation and when the purge of the canister 28 is enabled, the flow through the purge line 32 may have a high concentration of fuel vapor. If this vapor is allowed to enter the engine induction system at the maximum purge flow rate established by the engine manifold vacuum, the ability of the closed loop fuel adjustment provided by the ECM 36 may be incapable, due to the limited authority of the integral term as above described, of adjusting the fuel pulse width provided to the injector to maintain the desired stoichiometric air/fuel ratio. Therefore, the ECM 36 duty cycle modulates the purge valve 34 to provide an effective restriction that limits the purge flow rate from the canister 28 based on the amount of the closed loop integral term adjustment of the fuel pulse provided to the injector so that the maximum possible purge flow rate is established while yet ensuring that the fuel control system is capable of maintaining the desired air/fuel ratio.

In order to achieve the above control, the ECM 36 further receives a pulse output from a conventional ignition distributor which generates a pulse for each cylinder during each engine cycle and the output of a conventional throttle position sensor indicating the position of the throttle blade in the throttle body 12.

Figure 2:
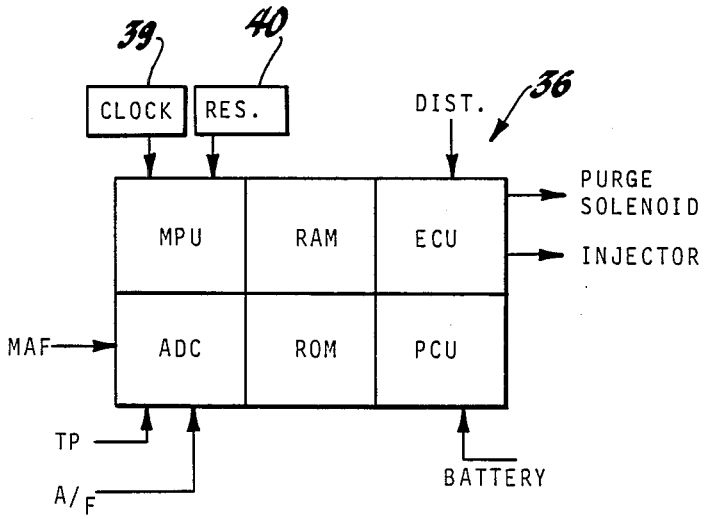
FIG. 2 is a diagram of the digital engine control module of FIG. 1 that is operative to control the fuel delivered to the engine and to control the purge flow rate of the fuel vapor collection canister.

Referring to FIG. 2, the ECM 36 takes the form of a digital computer. The digital computer is standard in form and includes a microprocessing unit (MPU) which executes an operating program permanently stored in a read only memory (ROM) which also stores tables and constants utilized for establishing the fuel requirements of the engine 10 and for controlling the purge valve 34 in accord with the principles of this invention. Contained within the MPU are conventional counters, registers, accumulators, and flag flip flops. The MPU receives inputs from a two-phase clock 39 and generates the required timing signals for the remainder of the system. The MPU further receives an input from a restart circuit 40 which generates a signal for initiating the remaining components of the system upon startup of the vehicle engine 10 such as by operation of the standard vehicle ignition switch.

The digital computer also includes a random access memory (RAM) into which data may be temporarily stored and from which data may be read at various address locations determined in accord with the programs stored in the ROM. A power control unit (PCU) receives the voltage from the vehicle battery through the vehicle ignition switch and provides regulated power to the various operating circuits in the ECM 36. An engine control unit (ECU) is provided that may take the form of the engine control module described in the U.S. Pat. No. 4,236,213 which issued Nov. 25, 1980 and which is assigned to the assignee of this invention. In general, the ECU provides a programmed pulse width modulated output to the purge solenoid 34 having a duty cycle determined in accord with the operating program stored in the ROM. Further, the ECU provides a pulse output to the fuel injector upon receipt of each engine rpm signal from the ignition distributor. These pulses are provided once for each engine intake event and are utilized by the ECU to initiate the injection of fuel to the engine.

The digital computer further includes an analog to digital converter (ADC). The ADC receives a plurality of engine parameter inputs including the mass air flow signal MAF representing the mass air flow into the engine 10, the throttle position signal TP indicating the position of the throttle blade in the throttle body 12 and the output signal A/F from the exhaust gas sensor 38 indicating the rich-lean state of the mixture supplied to the engine 10. The signals applied to the ADC are each sampled and converted under control of the MPU and stored in ROM designated RAM memory locations.

When power is first applied to the ECM 36 such as by operation of the vehicle ignition switch, the restart signal from the restart circuit 40 provides initialization of the digital computer. During this initialization, initial values stored in the ROM are entered into ROM designated locations in the RAM and counters, flags and timers are initialized. Thereafter, the program proceeds to execute the operating program stored in the ROM to control the fuel injector to provide the fuel requirements of the engine and to control the purge valve 34.

The fuel control routine for controlling the fuel flow into the engine 10 is a standard fuel control routine that determines the base fuel amount in the form of a base fuel pulse width for each engine cylinder intake event required to produce a predetermined air/fuel ratio based on the mass air flow into the engine. This base fuel pulse width is then adjusted in either a fuel increasing or decreasing direction by a closed loop adjustment factor so as to precisely obtain the desired air/fuel ratio. Since this form of fuel control is standard, only the portion generally illustrating the generation of the closed loop correction factor for obtaining the precise desired air/fuel ratio will be described. This closed loop fuel routine which is repeated at timed intervals is generally illustrated in FIG. 3.

The closed loop adjustment to the base fuel pulse width provided by the closed loop fuel routine is in the form of a multiplier having a value greater than unity to effect an increase in the base fuel pulse width and a value less than unity to effect a decrease in the base fuel pulse width.

Figure 3:
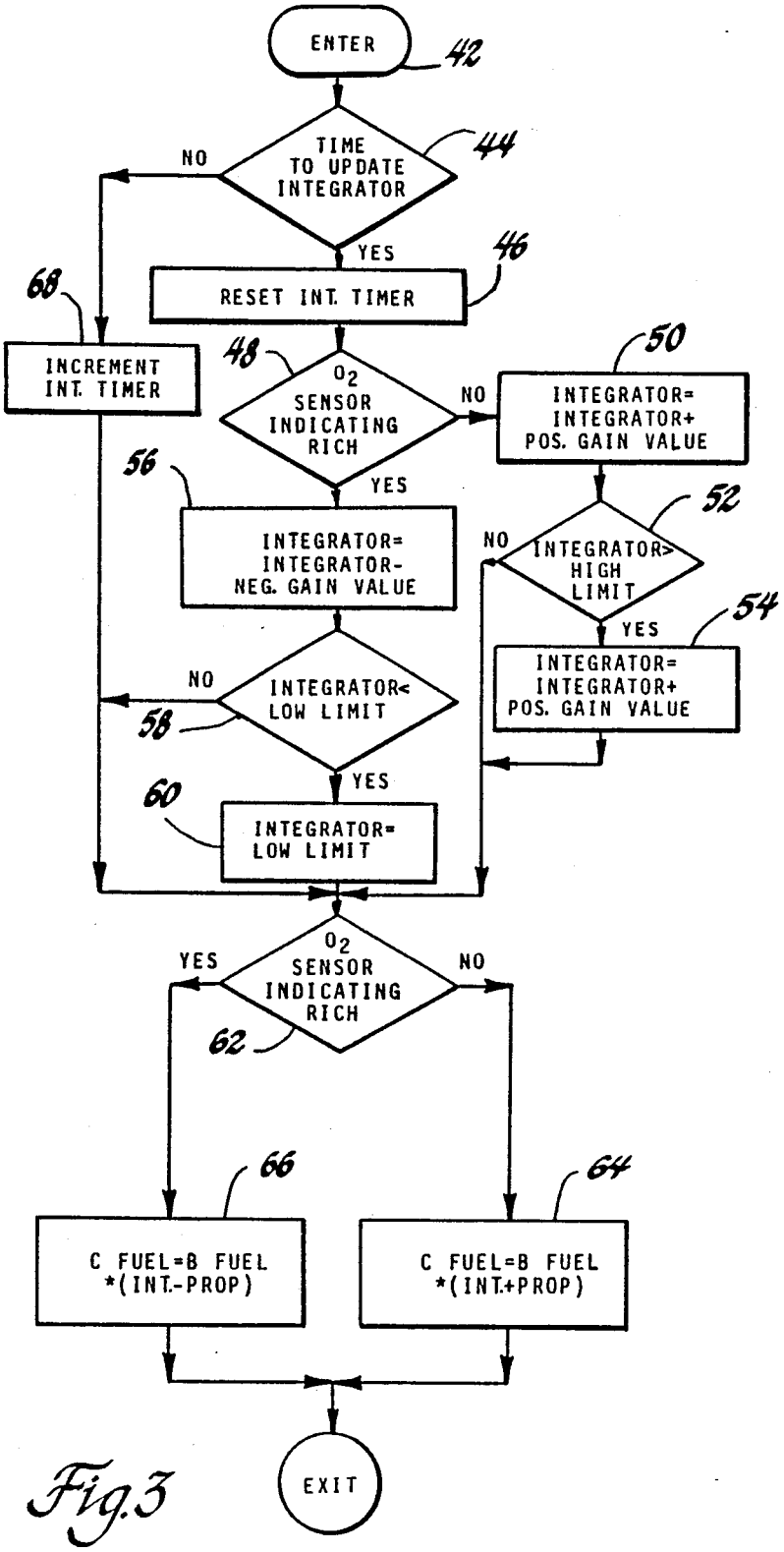
FIGS. 3 and 4 are diagrams illustrating the operation of the digital engine control module of FIG. 2 in controlling the purge flow rates of the fuel vapor canister.

Referring to FIG. 3, the closed loop fuel routine is entered at point 42 and proceeds to a step 44 where it determines whether or not a specified time since the last update of the integral term of the closed loop adjustment has expired. In one embodiment, the time is the engine transport delay (the time for a fuel-air mixture supplied to the engine to be drawn into the engine, burned and discharged into the exhaust manifold where it is sensed by the oxygen sensor 38). This transport delay time may be determined as a function of air flow. If the time since the last adjustment of the integral term is greater than the transport delay time, the program proceeds to a step 46 where the integrator timer is reset to condition it to again time the transport delay time interval.

Next, the program proceeds to a step 48 where the rich or lean state of the oxygen sensor is sensed. If the sensor indicates the air/fuel ratio of the mixture supplied to the engine is lean, the program proceeds to a step 50 where the integral term of the closed loop adjustment is increased by a positive gain value. Thereafter the program proceeds to a step 52 where the integral term is compared to a maximum high limit. If the integral term as adjusted is greater than this limit representing the maximum control authority of the integral term in increasing the base fuel pulse width, the program proceeds to a step 54 to limit the integrator value to the higher limit.

Returning again to step 48, if the oxygen sensor indicates that the air/fuel ratio is rich, the program proceeds to a step 56 where the integral term is decreased by a negative gain value. Thereafter the integral term is compared with a low limit at step 58, the low limit establishing the maximum control authority of the integral term in decreasing the base fuel pulse width. If the integral term is less than the low limit, the program proceeds to a step 60 where the integrator is set at the low limit value.

From step 52, 54, 58 or 60, the program proceeds to step 62 where the rich-lean state of the oxygen sensor is again sensed. If the oxygen sensor indicates the air/fuel ratio is lean, the program proceeds to a step 64 where the closed loop adjusted fuel pulse width is set equal to the base fuel pulse (determined from the mass air flow into the engine and the stoichiometric air/fuel ratio) times the sum of the integral term established at step 50 or step 56 plus a constant proportional term value. The integral plus proportional term constitutes the closed loop fuel adjustment and comprises the factor that increases the base fuel amount if greater than unity and decreases the base fuel amount if less than unity. Similarly, if the oxygen sensor indicates the air/fuel ratio is rich, the program proceeds from step 62 to a step 66 where the closed loop adjusted fuel pulse width is set equal to the base fuel pulse width multiplied by the integral term minus the constant proportional term value. In this case, the integral term minus the proportional term constitutes the closed loop adjustment. Again, a value of the closed loop adjustment term greater than unity increases the base fuel amount and a value less than unity decreases the base fuel amount.

From step 64 or step 66, the program exits the closed loop fuel routine of FIG. 3.

Upon the next execution of the routine of FIG. 3, the program proceeds from step 44 to a step 68 to increment the integrator timer. Thereafter, the program proceeds to the step 62 and thereafter to step 64 or step 66 as previously described. Upon repeated executions of the routine of FIG. 3, the program increments the integrator timer at step 68 until the time is determined to be greater than the transport delay after which the program proceeds to adjust the integral term at step 50 or 56 as previously described in the direction tending to restore the air/fuel ratio of the mixture supplied to the engine to the stoichiometric ratio.

The integral term is repeatedly adjusted as above described and attains a value at which the air/fuel ratio of the mixture drawn into the cylinders for combustion is at the desired stoichiometric ratio. If the air/fuel ratio should change, the integral term is adjusted as above described until the desired stoichiometric ratio is again restored. The high and low limit values established by steps 54 and 60 establish the control authority limits of the closed loop fuel routine. If the integral term should reach either of those limits in response to a rich or lean air/fuel ratio, the closed loop fuel routine becomes incapable of maintaining the desired air/fuel ratio. The ability of the closed loop fuel routine to establish the desired air/fuel ratio exists only if the integral term required to adjust the base fuel pulse width to obtain the desired ratio is within the high and low limits.

From the foregoing description of the closed loop fuel routine, it can be seen that as fuel vapors are drawn into the induction system of the engine 10 upon purging of the vapor collection canister 28 resulting in a decrease in the air/fuel ratio of the mixture provided to the induction system, the integral term of the closed loop adjustment will be repeatedly decreased via step 56 so as to effect a decrease in the base fuel pulse width at step 66 as a result of the rich air/fuel ratio caused by the fuel vapors until such time that the integral term has decreased the base fuel pulse width at step 66 to the value that restores the stoichiometric ratio. However, if the fuel vapors drawn into the engine from the canister 28 were to become too great, the integral term would reach its limit established at step 58. At this time, the closed loop routine of FIG. 3 would be incapable of further decreasing the base fuel pulse width and therefore would be incapable of maintaining the desired stoichiometric ratio.

Figure 4:
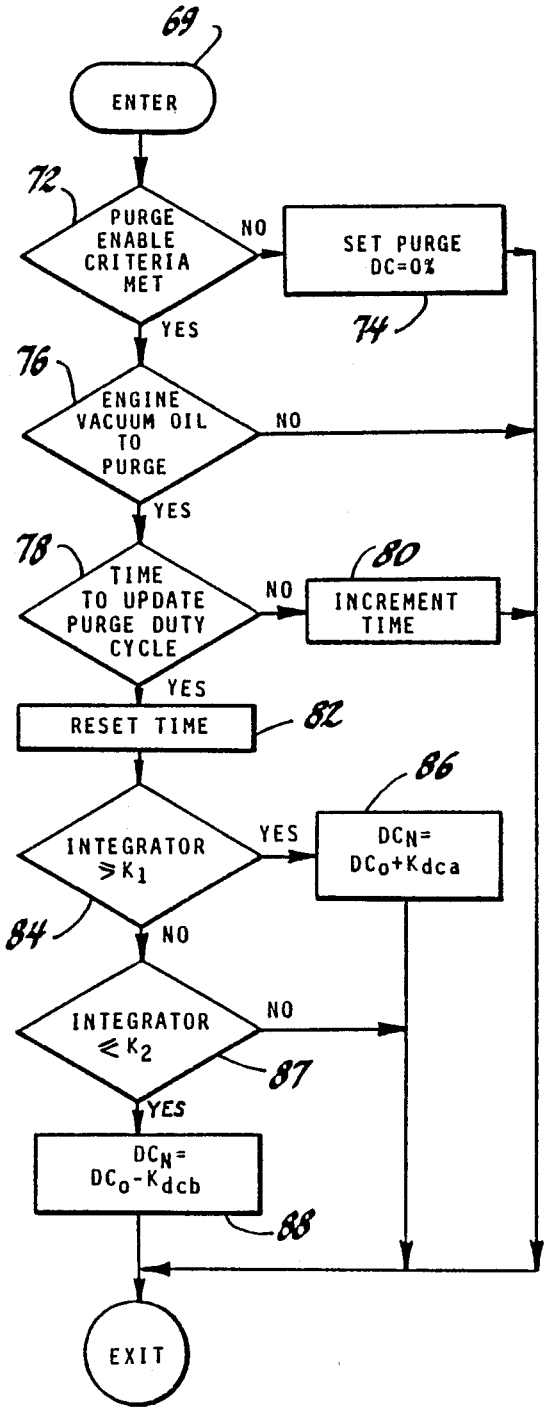

In accord with this invention, the closed loop integral term established by the routine of FIG. 3 is continually monitored by the closed loop canister purge routine of FIG. 4 while the purge flow rate through the purge conduit 32 is increased by increasing the duty cycle of the signal applied to the solenoid valve 34. When the closed loop canister purge routine of FIG. 4 senses the integral term approaching the low limit established at step 58 at which the closed loop fuel routine of FIG. 3 becomes incapable of maintaining the stoichiometric ratio, the closed loop canister purge controller decreases the duty cycle of the signal applied to the purge valve 34 to decrease the purge flow rate through the canister 28 or, in another embodiment, holds the duty cycle. In this manner, the closed loop fuel adjustment is not allowed to reach its control limit. At the same time the canister purge flow rate is maintained at the maximum possible rate which assures that the working capacity of the vapor canister 28 is maximized.

Referring to FIG. 4, the canister purge control routine is illustrated. This routine is repeatedly executed at timed intervals which may be the same at the closed loop fuel routine of FIG. 3. The routine is entered at point 69 and proceeds to a step 72 where it determines whether or not the purge enable criteria has been met. One such criteria is whether or not the closed loop fuel routine of FIG. 3 has been enabled. As is well known, closed loop fuel routines are generally disabled during certain engine operating conditions such as during engine warm up where it is desired to provide an air/fuel ratio different from the stoichiometric ratio. Additional criteria may include, for example, the throttle position being greater than a predetermined value. If the criteria have not been met, the program proceeds to a step 74 where the purge duty cycle provided to the ECU is set equal to zero%. This value disables the purge valve 34 which prevents any purging of the canister 28.

If the purge criteria have been met, the program proceeds from the step 72 to a step 76 where the program determines whether or not the engine vacuum is at a level for enabling purging of the vapor canister 28. This may be determined by mass air flow in conjunction with engine speed. If it is determined that the engine vacuum is not at a level to enable purge, the program exits the routine. However, if the vacuum level is at an acceptable level to enable purge, the program proceeds to a step 78 where it determines whether or not the time for updating the purge duty cycle has expired. In one embodiment, the time between adjustments of the duty cycle of the signal to the purge valve 34 is one second. If the time has not expired, the program proceeds to a step 80 where the time is incremented after which the program exits the purge control routine. If, however, the time has expired, the program proceeds from step 78 to step 82 where the timer is reset to condition it to again time the interval between updates of the purge control valve duty cycle.

From step 82, the program proceeds to a step 84 where it determines if the value of the integral term of the closed loop fuel routine as described in FIG. 3 is equal to or greater than a calibration constant $K_1$. If greater, indicating the closed loop integral term has not reached its control authority limit in the mixture leaning direction, the program proceeds to a step 86 where the new duty cycle value of the signal to be applied to the purge control valve 34 is increased by a constant value $K_{dca}$. The new duty cycle value is provided to the ECU which adjusts the duty cycle value applied to the purge valve 34 to increase the purge flow rate through the purge conduit 32. Thereafter, the program exits the canister purge control routine.

If at step 84 it is determined that the closed loop integral term is less than the value $K_1$ indicating it is approaching its control authority limit in the fuel reducing direction, the program proceeds to a step 87 where the integral term of the closed loop fuel routine is compared with a second calibration constant $K_2$ that is less than the value $K_1$. The values $K_1$ and $K_2$ establish a deadband wherein no adjustment of the canister purge flow rate is made. If the value is greater than $K_2$ indicating the integral term is within that deadband, the program exits the canister purge control routine.

If at step 87 the closed loop fuel integral term is determined to be equal to or less than $K_2$, it is an indication that the integral term has approached the low limit of its capability of removing fuel from the base fuel pulse width. When this condition exists, any further increase in the purge flow rate of the vapor collection canister 28 may result in the control authority of the closed loop control being exceeded. To prevent this condition from occurring and to ensure that the desired air/fuel ratio is continually maintained by the closed loop control routine of FIG. 3, the new duty cycle value provided to the ECU is decreased by a calibration constant $K_{dcb}$ at step 88 to effect a decrease in the duty cycle of the signal applied to the purge control valve 34 and therefore the purge flow rate through the canister 28. This decrease provides for a decrease in the flow rate of fuel vapors drawn into the induction system of the engine 10 from the vapor collection canister 28. The closed loop fuel routine of FIG. 3 responds to the resulting sensed lean air/fuel ratio to increase the integral term away from its low limit to restore the air/fuel ratio to the desired value.

As the amount of fuel vapors returned to the induction system of the engine decreases as the canister is purged, the integral term of the closed loop fuel routine increases toward unity to maintain the desired air/fuel ratio since less fuel is required to be removed from the base fuel pulse in order to maintain the stoichiometric ratio. As this occurs, the routine of FIG. 4 increases the duty cycle of the signal applied to the purge control valve 34 to increase the purge flow rate via the step 86. Upon repeated executions of the routine of FIG. 4, this duty cycle is continually increased until either the valve 34 is maintained continuously open or the integral term again decreases to below the value $K_1$ at step 84 after which the purge flow rate is again limited via the steps 87 and 88 as described above.

In the foregoing manner, the canister purge flow is continually adjusted in an increasing direction as limited only by the ability of the closed loop fuel control routine to adjust the air/fuel ratio to the stoichiometric value. In this manner, the maximum purge flow is always achieved while maintaining engine drivability and emissions. As a result, the capacity of the fuel vapor canister 28 to absorb vapors is maximized.

In the embodiment described, when the purge flow results in the integral control term approaching its authority limit, the duty cycle of the signal applied to the purge valve 34 was decreased. However, the value of $K_{dcb}$ of step 88 may be zero so that the duty cycle of the purge control valve is frozen until such time that the vapors purged from the canister 28 decreases resulting in the closed loop integral term moving away from its control authority limit. Additionally, the value of $K_{dcb}$ may be substantially less than the value of $K_{dba}$ utilized in step 86 so that the effective gain of the closed loop canister purge controller is greater in the direction increasing the duty cycle of the signal applied to the purge valve 34 as opposed to the gain of the controller in decreasing the duty cycle.

The foregoing description of a preferred embodiment for the purposes of illustrating the invention is not to be considered or restricting the invention since many modifications may be made by the exercise of skill in the art without departing from the scope of the invention.

The embodiments of the invention in which an exclusive property or privilege is claimed are defined as follows:

1. The method of controlling the purge flow rate from a fuel vapor collection canister to the induction system of an internal combustion engine having a system for delivering a mixture of air and fuel to the induction system and a closed loop controller for adjusting the fuel delivered to the induction system in a fuel increasing or decreasing direction so as to maintain a predetermined air/fuel ratio, the method comprising the steps of:

sensing the closed loop controller adjustment of the fuel delivered to the induction system; and progressively increasing the purge flow rate from the fuel vapor collection canister to the induction system during the period that the sensed closed loop controller adjustment in a fuel decreasing direction is less than a first predetermined value.

2. The method of claim 1 further including the step of decreasing the purge flow rate from the fuel vapor collection canister to the induction system during the period that the sensed closed loop controller adjustment in a fuel decreasing direction is greater than a second predetermined value that is greater than the first predetermined value, the first and second predetermined values forming a deadband therebetween at which the vapor purge flow rate is maintained constant.

3. The method of controlling the air and fuel mixture delivered to the induction system of an internal combustion engine during engine operation, the engine having a fuel tank and a fuel vapor collection canister for collecting fuel vapors from the fuel tank, the method comprising the steps of:

delivering fuel to the induction system of the engine in an amount determined to establish a predetermined air/fuel ratio;

sensing the air/fuel ratio of the mixture delivered to the induction system;

adjusting the amount of fuel delivered to the induction system of the engine by an amount whereat the sensed air/fuel ratio is equal to the predetermined ratio;

purging the fuel vapors collected by the fuel vapor collection canister into the induction system of the engine at an increasing rate, the fuel vapors tending to decrease the air/fuel ratio of the air and fuel mixture delivered to the induction system; and limiting the purging rate of fuel vapors purged from the fuel vapor collection canister into the induction system of the engine to the rate at which the adjustment to the amount of fuel delivered to the induction system of the engine in direction increasing the air/fuel ratio of the air and fuel mixture delivered to the induction system equals a predetermined value.

4. For an internal combustion engine having an induction system into which an air-fuel mixture is drawn and having an exhaust passage into which combustion gases are discharged, a system comprising in combination:

a fuel tank;

a mixture supply means for supplying a mixture of air and fuel to the induction system;

a sensor responsive to the combustion gases in the exhaust passage for generating an air/fuel ratio signal related to the value of the air/fuel ratio of the mixture supplied by the mixture supply means;

means responsive to the air/fuel ratio signal for providing an integral term adjustment to the air/fuel ratio of the air-fuel mixture supplied by the mixture supply means in a direction and by an amount to establish a predetermined air/fuel ratio;

a fuel vapor storage element for storing fuel vapors from the fuel tank;

a fuel vapor purge line for communicating the fuel vapor storage element to the induction system so that fuel vapors stored in the fuel vapor storage element may be purged therefrom and into the induction system during engine operation, the fuel vapor purge line including a purge control valve for regulating the flow of fuel vapors through the fuel vapor purge line; and purge control means responsive to the value of the integral term adjustment for controlling the purge control valve so as to increase the flow of fuel vapors through the fuel vapor purge line during the period that the integral term adjustment in the direction increasing the air/fuel ratio is less than a predetermined value and limiting the flow of fuel vapors through the fuel vapor purge line at a flow whereat the integral term adjustment in the direction increasing the air/fuel ratio is equal to the predetermined value.

* * * * *